United States Patent [19]

Kobayashi

[11] Patent Number: 4,949,658

[45] Date of Patent: Aug. 21, 1990

[54] TAPE FEEDING DEVICE IN A TAPE WINDING STITCHING MACHINE

[75] Inventor: Hideyuki Kobayashi, Tochigi, Japan

[73] Assignee: SSMC Inc., Edison, N.J.

[21] Appl. No.: 348,432

[22] Filed: May 8, 1989

[30] Foreign Application Priority Data

Jun. 14, 1988 [JP] Japan ..... 63-78556[U]

[51] Int. Cl.[5] ..... D05B 35/06

[52] U.S. Cl. ..... 112/137; 112/121.27; 112/285; 112/322

[58] Field of Search ..... 112/137, 285, 149, 322, 112/121.27, 152

[56] References Cited

U.S. PATENT DOCUMENTS

| | | | |
|---|---|---|---|
| 2,428,421 | 10/1947 | Gronenberg | 112/137 |
| 4,366,764 | 1/1983 | McCurry, III | 112/121.27 |
| 4,708,072 | 11/1987 | Frye | 112/121.27 |
| 4,748,922 | 6/1988 | Bierbaum et al. | 112/121.27 X |

*Primary Examiner*—Andrew M. Falik

*Attorney, Agent, or Firm*—Theodore Jay

[57] ABSTRACT

A tape feeding device comprises a binder arrangement for bending shape tape so that the bent portion thereof extends longitudinally. The binder includes a first binder for guiding a base of the tape and a second binder for bending the tape in a predetermined shape while guiding a tip end of the tape. A cutting unit is disposed between the first and the second binders to cut the tape. A tape feeding mechanism feeds the tape from the first binder to the second binder after the tape is cut by the cutting unit.

4 Claims, 2 Drawing Sheets

TAPE FEEDING DEVICE IN A TAPE WINDING STITCHING MACHINE

BACKGROUND OF THE INVENTION

1. Field of the Invention

The present invention relates to a tape feeding device in a tape winding stitching machine for winding and stitching the tape on the edge of a sewn material.

2. Description of the Prior Art:

In the sewing machine of this type, firstly, a tape unwound from an unwinding reel is bent by a binder and fed toward and wound on a sewn material in a predetermined length; secondly, the edge of the sewn material is sewn together with thus wound tape; thirdly, the end of the tape is cut after the edge of the sewn material is sewn together with the tape.

The cut end of the tape preferably should be positioned adjacent to sewn material in order to reduce the length of the remaining end of the tape to the extent possible. However the cut end is positioned at an inlet side of the binder which bends the tape in order to prevent interference with the needle and the presser metal of the sewing machine. At the time when the tape is drawn from the binder and the thus drawn tape is cut by cutting means such as a scissors, a next new tape is to be passed into the binder. At the time when the tape is passed into the binder, the tip end of the tape is cut on a slant so that the tape can be passed easily into the binder while the tape is delivered manually into a long tube of the binder. This results in a laborious and inefficient operation.

SUMMARY OF THE INVENTION

Accordingly, it is an object of the present invention to provide a tape feeding device which overcomes the problems of the prior art device.

Accordingly, a tape feeding device in accordance with the present invention comprises binder arrangement for bending a belt shape tape so that the bent portion thereof extends longitudinally. The binder arrangement includes a first binder for guiding a base of the tape and a second binder for bending the tape in a predetermined shape while guiding a tip end of the tape. The device also includes a cutting means disposed between the first and the second binder for cutting the tape. A tape feeding mechanism feeds the tape from the first binder to the second binder after the tape was cut by the cutting means.

The above and other objects, features and advantages of the present invention will either be explained or will become more apparent hereinafter.

DESCRIPTION OF PREFERRED EMBODIMENT

Figure 1:
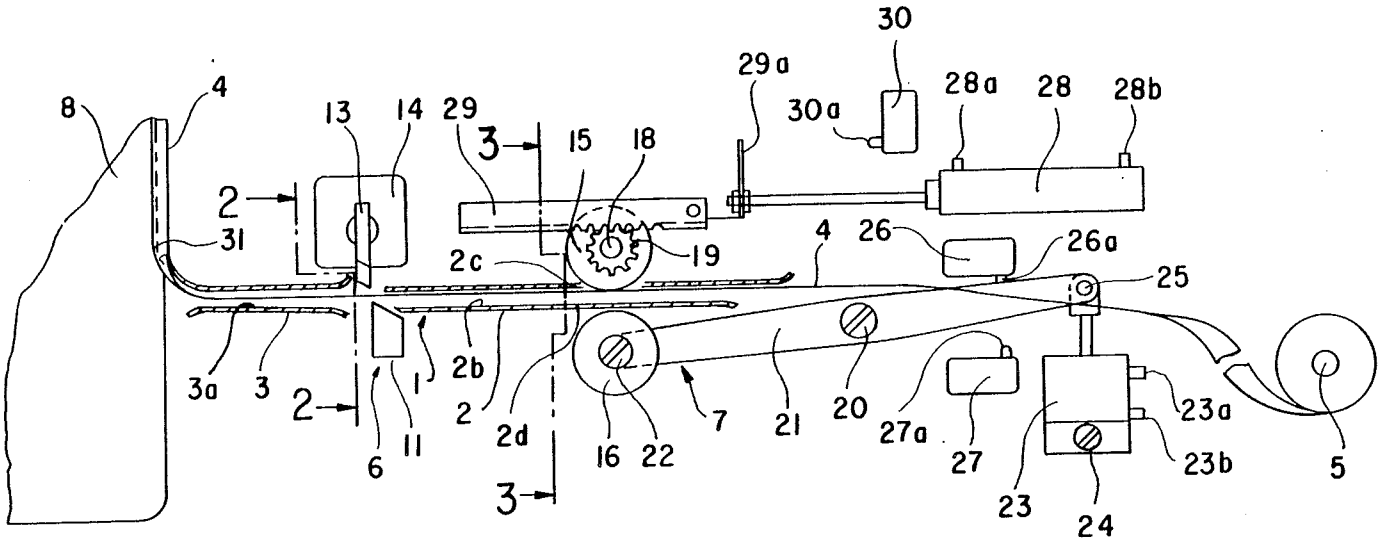
FIG. 1 is a side view of a tape feeding device in accordance with a preferred embodiment of the present invention.

A preferred embodiment of the present invention will be described with reference to FIG. 1 to 4.

A tape feeding device in a tape winding stitching machine comprises a binder arrangement 1 for bending a belt shape tape 4 so that the bent portion thereof extends longitudinally. Arrangement 1 is composed of a first binder 2 for preparing the tape for bending by applying an initial deformation and guiding the belt shape tape 4. A second binder 3 bends the previously deformed tape in a predetermined final shape while guiding the same tape. A cutting means 6 is disposed between the first and the second binders for cutting the tape extending therebetween. A tape feeding mechanism 7 feeds the tape from the first binder 2 to the second binder 3 after the tape 4 is cut off.

The arrangement of these components is described more in detail.

Figure 2:
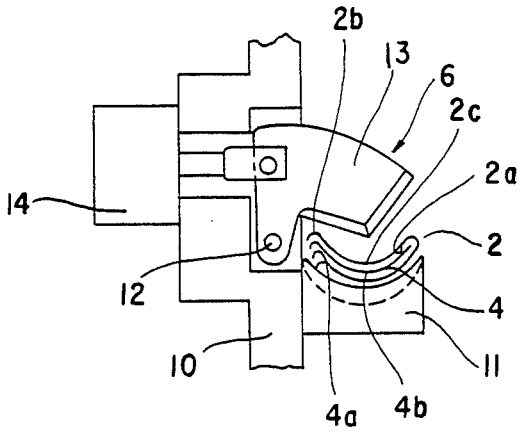
FIG. 2 is a cross sectional view taken along II—II of FIG. 1.
Figure 3:
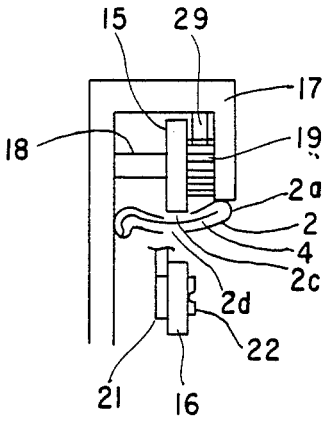
FIG. 3 is a cross sectional view taken along III—III of FIG. 1.
Figure 4:
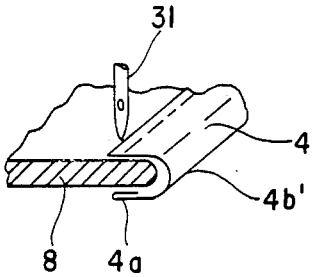
FIG. 4 is a perspective view illustrating the relationship of needle, tape and sewn material.

The first binder 2 has a flat tubular shape and a guide passage **2*a* (right side in FIG. 1) having one end thereof with a substantially rectangular cross section. A middle portion of binder 2 is gradually deformed as illustrated in FIG. 3 so that the other end has a V-shaped bent portion 2*b* at one edge side and a U-shaped bent portion 2*c* curved in a direction opposite to that of the V-shaped bent portion on the other edge side as illustrated in FIG. 2. The tape initially wound on a supply reel 5 is inserted into the one end of the guide passage 2*a* as a flat state, and as it passes through this passage it is bent to form a V-shaped bent portion 4*a* corresponding to the V-shaped bent portion 2*b* of the guide passage 2*a* and a U-shaped bent portion 4*b* corresponding to the U-shaped bent portion 2*c* of the guide passage 2*a* as illustrated in FIG. 2. Both V-shaped and U-shaped bent portions are extended in the longitudinal direction of the tape 4. Then the tape 4 is drawn out from the other end of the guide passage 2*a*. The second binder 3 has a passage 3*a* having one end of a shape opposite to and capable of connecting to the other end of the first binder 2. The other end as is known in the art has a V-shape adapted for bending the tape in a predetermined configuration. That is, the tape 4 drawn out from the other end of the second binder 3 has substantially the same configuration as that to be stitched on a sewn material 8 in the manner that the U-shaped bent portion 4*b* formed by the first binder 2 is guided by the V-shape bent portion 2*b* and bent in opposite direction to form U-shaped bent portion 4*b* as shown in FIG. 4. One end of the second binder 3 has a portion tapered toward the first binder 2 for receiving the tip end of the tape 4. Tape 4 being slightly elastic tends to return to its original position after being drawn out from the other end of the first binder 2. The first binder 2 if desired can function only to guide but not to bend the tape 4. In this case, only the second binder 3 will be used to bend the tape 4**.

The cutting device 6 includes a fixed knife 11 fixed to a supporter 10 attached to the upper portion of a bed of the sewing machine (not shown), a movable knife 13 pivotally mounted on the supporter 10 by a pin 12, and a cylinder 14 having a piston and pivotally connected to the movable knife 13 for rotatably driving the movable knife 13. The movable knife 13 is urged by a return spring (not shown) so as to return to a non-cutting operation position (shown in FIG. 2).

The tape feeding mechanism 7 is positioned at the side of the first binder 2 since it supplies the tip end of the cut tape 4 to the second binder 3. The tape feeding mechanism 7 includes a drive roller 15 having a knurled outer peripheral surface thereof for increasing the friction against the tape 4. Roller 15 is integrated with a pinion 19 and is secured to a shaft 18. Shaft 18 is rotatably supported by a supporter 17 fixed to the bed of the sewing machine. A driven roller 16 is rotatably supported by a pin 22 at one end of a swing lever 21 supported pivotably about a shoulder screw 20. The drive roller 15 and the driven roller 16 are respectively disposed at the first binder 2 so that provided with the drive roller 15 is positioned in an opening 2c and the driven roller 16 is positioned in an opening 2d. The swing lever 21 has at the other end thereof a cylinder 23 having a double acting piston for pivotally driving the swing lever 21. The cylinder 23 is attached pivotally to the side of the bed of the sewing machine by a pin 24 and has a double acting piston rod which is pivotally connected by a pin 25. The swing lever 21 swings around the shoulder screw 20 thereby allowing the driven roller 16 to move toward or away from the drive roller 15. The swing lever 21 swings at between maximum upper and lower positions. Limit valves 26, 27 respectively having push buttons 26a, 27a are disposed respectively at corresponding upper and lower maximum positions. When the swing lever 21 contacts either one of buttons 26a or 27a, a selector valve (not shown) is switched to actuate another cylinder 28 with a double acting piston for laterally moving a rack 29.

Rack 29 is supported in supporter 17 and is movable from a forward to a rearward direction and vice versa. Rack 29 has an end fixed to a rod of the double acting piston of the cylinder 28. As cylinder 28 is actuated, the rack 29 is moved forwardly and backwardly in linear movement thereof to rotate the pinion 19 and the drive 15 in the normal or a reverse direction. When the cylinder 28 is deactivated, a projection 29a fixed to the end of the rack 29 contacts a push button 30a of a limit valve 30 fixed to the bed side of the sewing machine. This action causes a selector valve (not shown) controlled by the limit valve 30 to be switched to a position at which fluid under pressure from a supply port 23b of the second 23 is released and allows the swing lever 21 to swing counterclockwise.

An operation of the tape feeding mechanism 7 in a tape winding stitching machine will be described herewith.

The tip end of the tape 4 is unwound from the supply reel 5 and is inserted into the one end of the first binder 2. The flat tape is preparatorily bent while it is guided along the flat tubular inside of the first binder 2, then passed through the second binder 3 and bent into the desired predetermined shape. One end of the sewn material 8 is held by the tape bent in the predetermined shape and extending from the binder 3. The sewn material thus held by the tape 4 is stitched by a needle 31 of the tape winding stitching machine to form a stitched portion. At the same time, the tape 4 and the sewn material 8 are fed together by a transfer unit of the tape winding stitching machine.

When the length of the tape 4 from the needle 31 to the cutting means 6 accords with the length of one edge of the uncompleted sewn material 8, a fluid under pressure is supplied to the cylinder 14, whereby the movable knife 13 swings around the pin 12 and moves downward toward the fixed arm 11 to cut instantly the sewn material 8. The tape remaining in the second binder 3 after the sewn material 8 is cut is stitched to the one edge of the sewn material 8.

When an operator pushes an actuation button (not shown) on the device, the selector valve is switched to supply a fluid under pressure to the supply port 23a of the cylinder 23 from a source of pressure (not shown). The second cylinder 23 moves downward to swing the swing lever 21 clockwise around the screw 20 whereby the driven roller 16 is brought into contact with the drive roller 15 while tape 4 is held. Because of this clockwise swinging movement of the swing lever 21, the other end of the swing lever 21 contacts the push button 27a of the limit valve 27 to switch the selector valve (not shown) connected to the limit valve 27 to supply fluid under pressure from the source of fluid to one supply port 28a of the cylinder 28 whereby the rack 29 is pulled by the cylinder 28. The pinion 19 engaged with the rack 29 causes the drive roller 15 to rotate clockwise to feed the tape 4 toward the second binder 3. The length of the tape to be fed is set so that the tip end of the tape 4 passes the second binder 3 thereby eliminating manual feeding of the tape 4.

At the time when the rack 29 is pulled, the projection 29a contacts the push button 30a of the limit valve 30 to switch the selector valve (not shown) controlled by the limit valve 30 so that fluid under pressure is applied to other supply port 23b of the cylinder 28, while the one supply port 23a is drained of fluid. The swing lever 21 swings counterclockwise to move the driven roller 16 away from the drive roller 15 while the other end of the swing lever 21 contacts the push button 26a of the limit valve 26 to switch the selector valve (not shown) connected to the limit valve 26 so that fluid under pressure is applied to other supply port 28b of the cylinder 28 and the one supply port 28a is drained of fluid. The rack is moved leftward thereby allowing the rack to return to its original position.

Each time the actuation button is pushed, the series of operations set forth above are repeated to automatically supply the tape.

The following advantages are obtained by the tape feeding device according to the present invention.

Firstly, since the belt shape tape is cut between the fixed and the movable cutting means, the cutting efficiency is remarkably improved as compared with the prior art manual operation, namely, drawing the tape from the binder and cutting the drawn tape.

Secondly, since the tape after cutting is held by the first binder and supplied safely and automatically to the second binder, the operator does not have to cut the tip end of the tape on a slant and feed the cut tape manually. Consequently, the feeding operation is improved compared with the prior art manual feeding operation. Furthermore, it is not necessary to cut the tape on a slant to use the tape economically, so that the practical utilization of the tape is remarkably increased.

Although the invention has been described in its preferred form with a certain degree of particularity, it is to be understood that many variations and changes are possible in the invention without departing from the scope thereof.

What is claimed is:

1. A tape feeding device in a tape winding stitching machine comprising:

a binder arrangement for bending a belt shape tape so that the bent portion thereof extends longitudinally, the arrangement including a first binder for guiding a base of the tape and a second binder for bending the tape in a predetermined shape while guiding a tip end of the tape, the first binder having a flat tubular shape and a guide passage having first and second opposite ends and a middle portion extending therebetween, the middle section being gradually deformed as it extends from the first end to the second end, the first end having a substantially rectangular cross section, the second end having a V-shaped bent portion at one edge side and a U-shaped bent portion curved in a direction opposite to that of the V-shaped bent portion on other and opposite edge side, the second binder having a first end, an opposite second end and a passage extending between the first and second ends, the first end of the second binder being adjacent the second end of the first binder, and having a shape opposite to that of the second end of the first binder, the second end of the second binder having a V-shape;

cutting means disposed between the first and the second binders for cutting the tape; and a tape feeding mechanism for feeding the tape from the first binder to the second binder after the tape was cut by the cutting means.

2. The device of claim 1 wherein the first end of the second binder is tapered and is adapted to receive the tip end of the tape from the first binder.

3. The device of claim 2 wherein the cutter means includes a stationary first knife, an oppositely disposed movable second knife, and means to move the second knife toward the first knife to perform a cutting operation and to move the second knife away from the first knife after the cutting operation has been completed.

4. The device of claim 3 wherein the second end of the first binder is spaced from the first end of the second binder and the first and second knives are disposed in the space between the two binders.

* * * * *